US010274899B2

(12) United States Patent
Bonnet et al.

(10) Patent No.: US 10,274,899 B2
(45) Date of Patent: Apr. 30, 2019

(54) THERMOCOMPENSATED CHRONOMETER CIRCUIT

(71) Applicant: ETA SA Manufacture Horlogere Suisse, Grenchen (CH)

(72) Inventors: Thierry Bonnet, Geneva (CH); Silvio Dalla Piazza, St-Imier (CH); Laurent Christe, Bienne (CH); Francois Klopfenstein, Delemont (CH); Emmanuel Fleury, Moutier (CH); Yves Godat, Cornaux (CH); Nicolas Jeannet, Chambrelien (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/649,029

(22) PCT Filed: Dec. 11, 2013

(86) PCT No.: PCT/EP2013/076291
§ 371 (c)(1),
(2) Date: Jun. 2, 2015

(87) PCT Pub. No.: WO2014/095538
PCT Pub. Date: Jun. 26, 2014

(65) Prior Publication Data

US 2015/0316895 A1 Nov. 5, 2015

(30) Foreign Application Priority Data

Dec. 21, 2012 (EP) ..... 12199274
Mar. 27, 2013 (EP) ..... 13161356

(51) Int. Cl.
*G04C 13/00* (2006.01)
*G04C 3/14* (2006.01)
*G04G 3/04* (2006.01)

(52) U.S. Cl.
CPC ..... *G04C 13/00* (2013.01); *G04C 3/14* (2013.01); *G04G 3/04* (2013.01)

(58) Field of Classification Search
CPC ..... G04G 3/04; G04C 3/14
(Continued)

(56) References Cited

U.S. PATENT DOCUMENTS 3,902,312 A 9/1975 Yamazaki
4,034,551 A * 7/1977 Ushiyama ..... G04C 3/005 368/189

(Continued)

FOREIGN PATENT DOCUMENTS

| | | |
|---|---|---|
| EP | 1 890 204 | 2/2008 |
| EP | 2 169 479 | 3/2010 |
| GB | 1 581 917 | 12/1980 |

OTHER PUBLICATIONS

International Search Report dated Jan. 10, 2014 in PCT/EP13/076291 filed Dec. 11, 2013.

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

An electronic module including at least one electric motor for driving an analog display, a clock module including a time base delivering a clock signal connected to a divider circuit, the divider circuit delivering a reference signal sent to a control circuit arranged to control the electric motor, the clock module further including a measuring and correction circuit arranged between the time base and the divider circuit and delivering an intermediate compensated signal. The time base, the compensation module, the divider circuit, and the control circuit are arranged in a same case to form the clock module.

20 Claims, 1 Drawing Sheet

(58) Field of Classification Search
USPC ..... 368/200–202
See application file for complete search history.

(56) References Cited

U.S. PATENT DOCUMENTS

| | | | | | |
|---|---|---|---|---|---|
| 4,162,608 | A * | 7/1979 | Morozumi | G04G 3/022 | 368/85 |
| 4,203,345 | A * | 5/1980 | Collin | G09B 15/003 | 84/478 |
| 4,270,197 | A * | 5/1981 | Minowa | G04F 8/006 | 368/102 |
| 4,540,291 | A * | 9/1985 | Dubois | G04C 3/008 | 368/187 |
| 4,649,341 | A * | 3/1987 | Ulbrich | G01B 7/02 | 324/207.16 |
| 4,761,771 | A * | 8/1988 | Moriya | G04G 3/022 | 368/202 |
| 5,473,580 | A * | 12/1995 | Gilomen | G04C 3/146 | 368/110 |
| 5,748,570 | A * | 5/1998 | Komoda | G04G 3/02 | 368/10 |
| 6,086,244 | A * | 7/2000 | Yin | G04G 3/02 | 368/117 |
| 2009/0160569 | A1 | 6/2009 | Gros | | |
| 2010/0080088 | A1 | 4/2010 | Koch | | |
| 2010/0246340 | A1 | 9/2010 | Meier et al. | | |
| 2011/0128826 | A1* | 6/2011 | Hasegawa | G04F 8/003 | 368/112 |
| 2012/0250469 | A1* | 10/2012 | White | G04G 3/04 | 368/160 |
| 2012/0306580 | A1* | 12/2012 | Ellis | G04G 3/04 | 331/2 |

* cited by examiner

THERMOCOMPENSATED CHRONOMETER CIRCUIT

CROSS-REFERENCE TO RELATED APPLICATIONS

This is a National phase application in the United States of International patent application PCT/EP2013/076291 filed Dec. 11, 2013 which claims priority on European patent application No. 12199274.7 filed Dec. 21, 2012, the entire contents of each of which are incorporated herein by reference.

FIELD OF THE INVENTION

The present invention concerns an electronic watch including one or more electric motors for driving an analogue display means, a clock module including a time base delivering a clock signal connected to a divider circuit, said divider circuit delivering a reference signal sent to a control circuit arranged to control the electric motor(s).

BACKGROUND OF THE INVENTION

There is known in the prior art, seen in FIG. 1, a time base formed for example by a piezoelectric resonator, such as a quartz resonator 1, or a silicon MEMS resonator connected to the terminals of an oscillator 2 whose output is connected to a frequency divider circuit 3 to obtain the required operating frequency for the watch to indicate the exact time. The output of frequency divider circuit 3 is connected to a control circuit 4 of an electric motor 5, for driving the gear trains, not shown here, rotating the analogue display means, such as hands used to provide the time indication, i.e. the hours, minutes and possibly seconds. The resonator, the oscillator, the divider circuit and the control circuit are placed in the same case 6.

However, it is not possible with this configuration to have a circuit that is independent of fluctuations in temperature, since no temperature compensation circuit is provided.

There are known thermally compensated timepiece circuits. These circuits include a timepiece module connected to a quartz and also connected to a temperature measuring and correction circuit. This measuring and correction circuit is thus arranged for measuring the temperature and correcting the operation of the clock circuit.

One drawback of these circuits is that they occupy space, i.e. they have a large surface area, and calibration is carried out on the assembled calibres. This increases the manufacturing cost of the temperature dependence correction performed on the calibres. Moreover, this configuration is sensitive to any moisture that infiltrates the timepiece case. This moisture sensitivity leads to a deterioration in the accuracy and reliability of the clock circuit.

Further, for a clock circuit having a chronograph function, there is the added drawback of having an additional module and thus the same problems of surface area and moisture sensitivity.

SUMMARY OF THE INVENTION

The invention concerns an electronic watch which overcomes the aforementioned drawbacks of the prior art by proposing a watch whose time display is reliable and accurate and which is less expensive to manufacture.

The invention therefore concerns an electronic watch including an electric motor for driving analogue display means, a clock module including a time base delivering a clock signal connected to a divider circuit, said divider circuit delivering a reference signal sent to a control circuit arranged to control said electric motor, characterized in that the clock module further includes a compensation module arranged between the time base and the divider circuit and delivering an intermediate compensated signal and in that the time base, the compensation module, the divider circuit and the control circuit are arranged in the same case to form said clock module, in that said watch further includes a chronograph module connected to the clock module and in that said chronograph module is clocked by the intermediate compensated signal from the clock module.

In an advantageous embodiment, the time base includes a resonator and an oscillator circuit.

In an advantageous embodiment, the time base delivers a 32 kHz clock signal.

In an advantageous embodiment, the chronograph module is arranged to control at least one electric motor.

In an advantageous embodiment, said clock module case is hermetically sealed.

In an advantageous embodiment, the clock module case is an integrated circuit incorporating the time base.

In an advantageous embodiment, the timepiece module case is made of ceramic.

The advantage of the present invention is that it can produce a watch whose clock module is reliable and not sensitive to external interference such as moisture and the temperature correction is performed on the clock module and not on the watch calibre.

Further, the present invention easily permits the manufacture of a chronograph clock module using the thermocompensated signal of the clock module which provides a reliable and inexpensive clock module.

The invention also concerns a method of calibrating at least one clock module including a time base delivering a clock signal connected to a divider circuit, said divider circuit delivering a reference signal sent to a control circuit arranged to control said electric motor, characterized in that the clock module further includes a measuring and correction circuit arranged between the time base and the divider circuit and delivering an intermediate compensated signal, characterized in that the method includes the following steps:

- assembling the time base, the divider circuit, the control circuit and the measuring and correction circuit in a case;
- closing the case;
- measuring the characteristics of the time base according to temperature;
- determining correction parameters;
- storing the correction parameters in the measuring and correction circuit.

In an advantageous embodiment, the case is hermetically sealed.

In an advantageous embodiment, a plurality of clock modules are simultaneously calibrated.

In an advantageous embodiment, the clock module case is hermetically vacuum sealed.

In an advantageous embodiment, the method further includes a step consisting in connecting a chronograph module to the clock module, and said chronograph module is clocked by the intermediate compensated signal from the clock module.

BRIEF DESCRIPTION OF THE DRAWINGS

Other advantages and features of the watch according to the present invention will appear more clearly in the following detailed description of embodiments of the invention, given solely by way of non-limiting example and illustrated by the annexed drawings, in which.

DETAILED DESCRIPTION OF THE INVENTION

Figure 1:
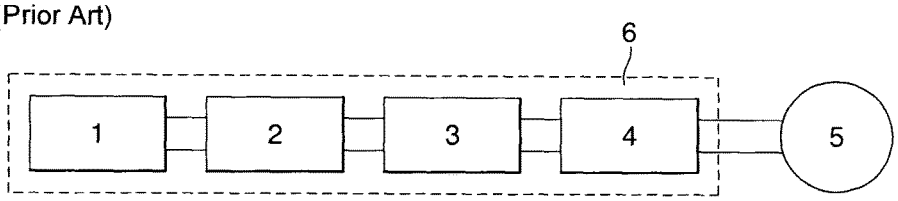
Fig. 1 (Prior Art)
FIG. 1 is a diagram of a prior art electronic watch with analogue display.
Figure 2:
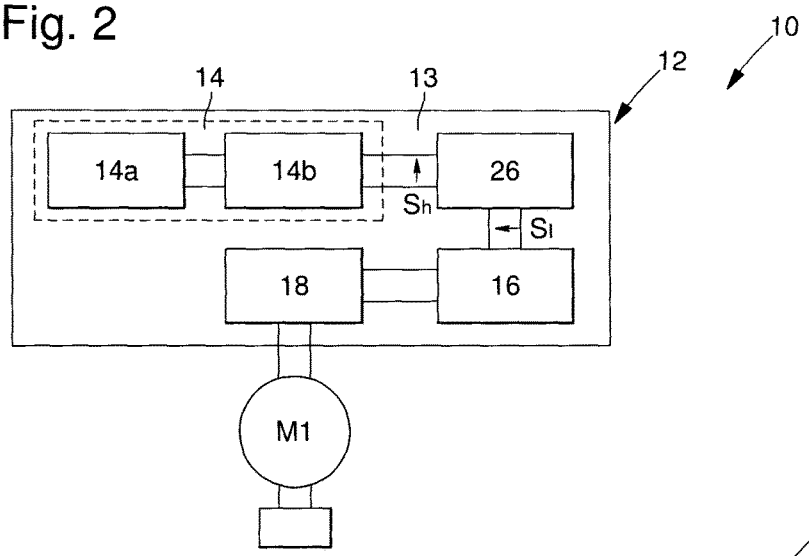
FIG. 2 is a diagram of an electronic watch with analogue display according to the invention.

According to a first embodiment of the invention shown schematically in FIG. 2, the invention concerns an electronic timepiece including a clock circuit 10 provided with a clock module 12. This clock module 12 includes a time base 14 formed by a resonator 14*a* for example a piezoelectric resonator such as a quartz resonator, or a silicon MEMS resonator connected to the terminals of an oscillator 14*b*. This oscillator 14*b* is used to deliver a clock signal Sh at a clock frequency. This clock frequency is generally 32768 Hz conventionally referred to as 32 kHz. In the remainder of the description, the term "32 kHz" will be used to refer to this value of 32768 Hz.

The oscillator output is connected to a frequency divider circuit 16 to obtain the working frequency required for the watch to indicate the exact time. For example, divider circuit 16 will deliver at output a frequency of 1 Hz so that the seconds hand can move at one step per second. The output of frequency divider circuit 16 is connected to control circuit 18. This control circuit 18 is used to control clock module 12, i.e. to regulate the rate of the timepiece and to control functions such as the low battery mode. It will be clear that control circuit 18, time base 14 and frequency divider circuit 16 may be in the form of a single component.

Clock circuit 10 is also provided with an electric motor M1 for driving the gear trains (not shown here), rotating the analogue display means, such as hands 22 used to provide the time indication, i.e. hours, minutes and possibly seconds. The electric motor is connected to control circuit 18 which controls the operation of said electric motor M1.

Advantageously according to the invention, control circuit 18, time base 14 and frequency divider circuit 16 are arranged in the same case 13 and the clock circuit further includes a measuring and correction circuit 26 for thermocompensation. This measuring and correction circuit 26 is placed between oscillator circuit 14*b* and frequency divider circuit 16. This measuring and correction circuit 26 is used to thermally compensate clock module 12, i.e. as a function of temperature it will act on the output signal from oscillator 14*b*, i.e. clock signal Sh. Measuring and correction circuit 26 acts to ensure that the output signal from said measuring and correction circuit 26 is accurate on average over a defined period. To achieve this, measuring and correction circuit 26 inhibits pulses in clock signal Sh. Consequently, the assembly formed of time base 14 and measuring and correction circuit 26 delivers a signal Si whose frequency is lower than the frequency of clock signal Sh. This is due to the fact that measuring and correction circuit 26 inhibits pulses, i.e. it removes pulses. For example, for a 32 kHz clock signal, a 8192 Hz frequency signal conventionally called a 8 kHz signal, which is thermocompensated i.e. accurate and reliable, will be delivered by the assembly formed of time base 14 and measuring and correction circuit 26.

To improve the reliability of clock module 12, case 13 in which it is arranged is made of ceramic and is hermetically sealed prior to calibration. Case 13 is placed in a vacuum then sealed. This ensures that no moisture will be able to infiltrate said case 13. Consequently, moisture will have no effect on the accuracy of clock module 12.

Indeed, one aspect of the invention consists in providing a calibration method for obtaining a clock circuit 10 which is reliable over the long term.

To achieve this, the method consists in assembling control circuit 18, time base 14, frequency divider circuit 16 and measuring and correction circuit 26 in the same case 13 to form clock module 12. Next, the calibration is performed in batches, i.e. at the same time. It is thus clear that a plurality of clock modules 12 are calibrated at the same time. This calibration consists in measuring the features of resonator 14*a* and of measuring circuit 26 as a function of temperature and then in determining correction parameters.

These correction parameters are stored in measuring and correction circuit 26. Thus, the correction parameters of each resonator 14*a* of a plurality of clock modules 12 are determined simultaneously.

This method thus has the advantage of permitting a large number of clock modules 12 to be simultaneously calibrated and thus of reducing the costs associated with calibration.

Figure 3:
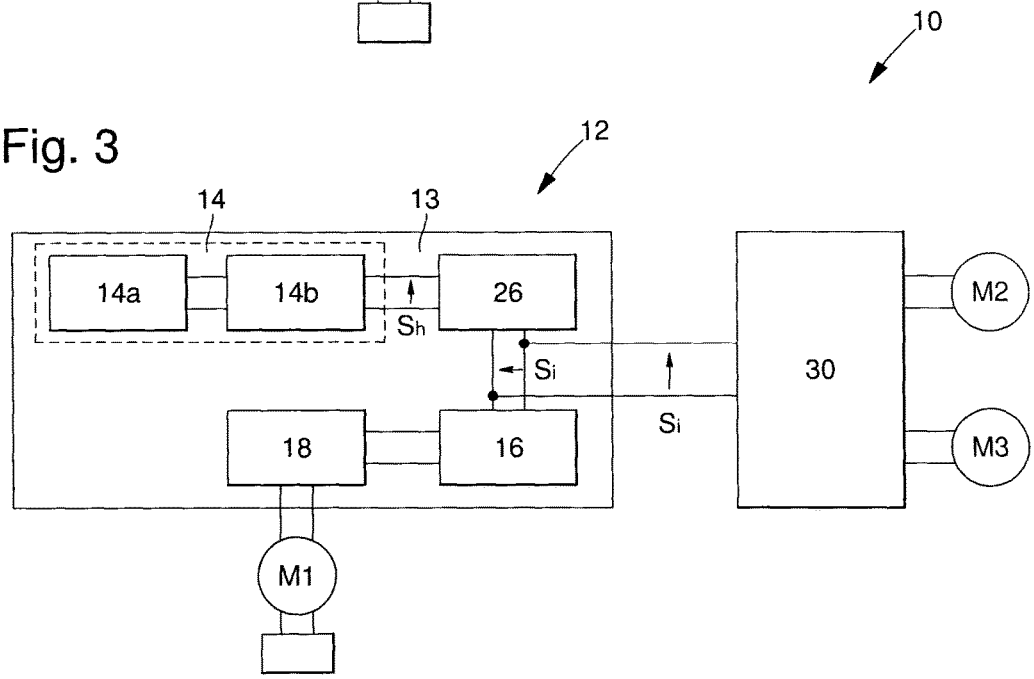
FIG. 3 is a diagram of an electronic watch with analogue display according to a variant of the invention.

Advantageously according to the invention, this configuration permits the simple manufacture of a thermocompensated chronograph module 30 as seen in FIG. 3.

Indeed, the present invention uses the clock signal from clock module 12 to clock a chronograph module 30. This chronograph module 30 includes a control circuit and circuits for operating the hands of the chronograph function. For example, the control circuit of chronograph module 30 is arranged to operate two motors M2 and M3. In that case, it is possible to envisage not having a motor M1 connected to clock module 12.

Preferably, chronograph module 30 is clocked with the thermocompensated signal, i.e. output signal Si from measuring and correction circuit 26 of clock module 12. In the aforecited example, for a clock signal Sh having a frequency of 32 kHz, a thermocompensated signal Si of frequency 8 kHz is obtained.

Consequently, chronograph module 30 is a module which does not have its own time base which reduces the cost of the module.

This thermocompensated signal Si delivered by clock module 12 is used to reconstruct useful signals for chronograph module 30. For example, the thermocompensated signal may be used to reconstruct a higher frequency signal for clocking a control circuit of the chronograph module. Consequently, the control circuit of the chronograph module can operate motors M2, M3 associated with this chronograph function.

The reconstructed higher frequency signal can be used for a function of determining the position of the gear trains.

There are advantages to the possibility of clocking a chronograph module with a thermocompensated clock module signal.

First of all, this permits the manufacture of a simple thermocompensated chronograph clock module. Indeed, known chronograph clock modules directly use the 32 kHz resonator output signal to operate. Using the signal directly at the resonator output means that the signal cannot be thermocompensated. Consequently, the operation of the chronograph clock module becomes random. Likewise, using an existing thermocompensated signal, means that it is unnecessary to make a chronograph module 30 having its own time base and its own measuring and correction circuit.

Conversely, with the present invention, it is possible to obtain a clock circuit 10 with an entirely thermocompensated chronograph function at a lower cost. Indeed, the present invention uses only clock module 12 and its thermocompensated signal Si at frequency 8 kHz to thermally compensate chronograph module 30, ensuring that the thermocompensated signal is used by said chronograph module. Consequently, it is easy to change from a clock module to a chronograph clock module.

Moreover, this configuration provides a chronograph clock module which is more economical in electrical energy. Indeed, the chronograph module uses a thermocompensated clock signal at a lower frequency than the frequency of time base 14. The higher the frequency, the greater the losses linked to interconnection capacities. Indeed, the transport of a signal at a certain frequency across a printed circuit board is subject to capacitive and inductive effects, and to any skin effects which may occur. These effects are all frequency connected, involving an increase in losses connected to these effects as a function of frequency. Consequently, to compensate for losses, a higher electrical power must be delivered.

With the configuration of the invention, a lower frequency is used to clock the chronograph module and thus losses linked to excessive consumption are lower.

It will be clear that various alterations and/or improvements and/or combinations evident to those skilled in the art may be made to the various embodiments of the invention set out above without departing from the scope of the invention defined by the annexed claims.

The invention claimed is:

1. An electronic watch comprising:

at least one electric motor for driving an analog display;

a clock module including a time base that includes a resonator and an oscillator circuit, the time base delivering a clock signal connected to a divider circuit, the divider circuit delivering a reference signal sent to a control circuit configured to control the electric motor;

wherein the clock module further includes a measuring and correction circuit arranged between the oscillator circuit and the divider circuit and delivering an intermediate compensated signal;

the time base, the measuring and correction circuit, the divider circuit, and the control circuit being arranged in a same case to form the clock module, and further comprising a chronograph module connected to the clock module, the chronograph module being clocked by the intermediate compensated signal from the clock module, such that the measuring and correction circuit is a single measuring and correction circuit that thermally compensates both the clock module and the chronograph module.

2. The electronic watch according to claim 1, wherein the time base delivers a 32 kHz clock signal.

3. The electronic watch according to claim 1, wherein the chronograph module is configured to control at least one electric motor.

4. The electronic watch according to claim 1, wherein the case of the clock module is hermetically sealed.

5. The electronic watch according to claim 1, wherein the case of the clock module is an integrated circuit in which the time base is incorporated.

6. The electronic watch according to claim 1, wherein the case of the clock module is made of ceramic.

7. The electronic watch according to claim 1, wherein the chronograph module is connected to an output of the measuring and correction circuit.

8. The electronic watch according to claim 1, wherein the measuring and correction circuit inhibits pulses from a clock signal output from the time base.

9. The electronic watch according to claim 1, wherein the measuring and correction circuit delivers the intermediate compensated signal whose frequency is lower than a frequency of a clock signal output from the time base.

10. The electronic watch according to claim 1, wherein the measuring and correction circuit delivers the intermediate compensated signal at a frequency of 8 kHz.

11. The electronic watch according to claim 1, wherein the electronic watch is structured so that the time base, the measuring and correction circuit, the divider circuit, and the control circuit are arranged in the same case and the at least one electric motor is arranged outside of the same case.

12. The electronic watch according to claim 1, wherein the measuring and correction circuit is directly connected to the time base and is directly connected to the divider circuit.

13. The electronic watch according to claim 1, wherein the chronograph module is connected to the clock module directly between the measuring and correction circuit and the divider circuit.

14. A method of calibrating at least one clock module including a time base that includes a resonator and an oscillator circuit, the time base delivering a clock signal connected to a divider circuit, the divider circuit delivering a reference signal sent to a control circuit configured to control an electric motor, wherein the clock module further includes a measuring and correction circuit arranged between the oscillator circuit and the divider circuit and delivering an intermediate compensated signal, the method comprising:

assembling the time base, the divider circuit, the control circuit, and the measuring and correction circuit in a case;

closing the case; and after the closing of the case, measuring characteristics of the time base as a function of temperature;

determining correction parameters with the control circuit; and storing the correction parameters in the measuring and correction circuit.

15. The calibration method according to claim 14, wherein the case is hermetically vacuum sealed.

16. The calibration method according to claim 14, wherein a plurality of clock modules are simultaneously calibrated.

17. The calibration method according to claim 14, further comprising connecting a chronograph module to the clock module, and the chronograph module is clocked by the intermediate compensated signal from the clock module.

18. The calibration method according to claim 17, wherein the chronograph module is connected to the clock module directly between the measuring and correction circuit and the divider circuit.

19. The calibration method according to claim 14, wherein the assembling includes assembling the time base, the divider circuit, the control circuit, and the measuring and correction circuit in the case with the at least one electric motor being arranged outside of the case.

20. The calibration method according to claim 14, wherein the measuring and correction circuit is directly connected to the time base and is directly connected to the divider circuit.

* * * * *